US005766350A

United States Patent [19]

Becker et al.

[11] Patent Number: 5,766,350

[45] Date of Patent: Jun. 16, 1998

[54] APPLICATOR SYSTEM FOR A WEB-COATING APPARATUS

[75] Inventors: Ingo Becker, Düsseldorf; Gerhard Wohlfeil, Monheim; Reinhard Knop, Essen; Hans Rückert, Ratingen, all of Germany

[73] Assignee: Jagenberg Papiertechnik GmbH, Neuss, Germany

[21] Appl. No.: 670,837

[22] Filed: Jun. 28, 1996

[30] Foreign Application Priority Data

Jul. 29, 1995 [DE] Germany ..... 195 27 903.4
Feb. 10, 1996 [DE] Germany ..... 196 04 934.2

[51] Int. Cl.[6] ..... B05C 1/00

[52] U.S. Cl. ..... 118/249; 118/126

[58] Field of Search ..... 118/258, 249, 118/261, 262, 410, 419, 117, 119, 122, 126

[56] References Cited

U.S. PATENT DOCUMENTS

| | | | |
|---|---|---|---|
| 4,245,582 | 1/1981 | Alheid et al. | 118/119 |
| 4,757,782 | 7/1988 | Pullinen | 118/411 |
| 4,869,933 | 9/1989 | Sollinger et al. | 427/356 |
| 5,599,392 | 2/1997 | Liang et al. | 118/110 |

FOREIGN PATENT DOCUMENTS

| | | |
|---|---|---|
| 0 454 643 | 10/1991 | European Pat. Off. . |
| 0 465 898 | 1/1992 | European Pat. Off. . |
| 533 643 | 3/1993 | European Pat. Off. . |
| WO 93/21385 | 10/1993 | European Pat. Off. . |
| 2949840 | 7/1980 | Germany . |
| 3145413 | 6/1982 | Germany . |
| 33 38 323.5 | 5/1984 | Germany . |
| 3338323 | 5/1984 | Germany . |
| 36 23 402.8 | 5/1987 | Germany . |
| 3623402 | 5/1987 | Germany . |
| 37 15 307.2 | 12/1988 | Germany . |
| 4033521 | 4/1991 | Germany . |
| 4014463 | 11/1991 | Germany . |
| 9103571 | 9/1992 | Germany . |
| 4309937 | 9/1994 | Germany . |
| 43 34 555.7 | 4/1995 | Germany . |
| 4334555 | 4/1995 | Germany . |
| 4341341 | 4/1995 | Germany . |
| WO93/23622 | 11/1993 | WIPO . |
| WO 94/23126 | 10/1994 | WIPO . |

*Primary Examiner*—Brenda A. Lamb
*Attorney, Agent, or Firm*—Herbert Dubno; Andrew Wilford

[57] ABSTRACT

In a web-coating apparatus a web moving continuously in a travel direction passes in a contact arc partially around a cylindrical surface of a backing roller centered on an axis. An applicator system has an applicator roller extending parallel to the backing roller, having a smooth cylindrical outer surface, and forming a gap with the backing roller. The web passes through the gap. A substantially stationary support extends generally parallel to the backing roll axis across a full width of the web and a pusher element limitedly movable generally radially toward and away from the backing-roller axis on the support bears radially of the backing-roller axis on the applicator roller along the full width of the web. An inflatable hose between the pusher element and the support along the full width of the web urges the element and applicator roller toward the backing roller. A coating liquid is supplied to the gap across the full width of the web.

19 Claims, 4 Drawing Sheets

3
2
γ2
4
7
d2
r2
β2
α
23
22A
β1
r1
19
11
10
22
d1
5A
5
10A
γ1
a
1
2

APPLICATOR SYSTEM FOR A WEB-COATING APPARATUS

FIELD OF THE INVENTION

The present invention relates to an apparatus for coating a web of paper or cardboard. More particularly this invention concerns an applicator system for such an apparatus.

BACKGROUND OF THE INVENTION

In a paper-making plant it is frequently necessary to apply a uniform coating of a liquid to a cardboard or paper web that is moving at a high rate of speed, often more than 1000 m/min. The coating liquid can be applied directly to the web or to a roller that subsequently transfers it to the web. The liquid is invariably extruded through a slot toward a backing roller. Normally the web is spanned over the backing roller so the liquid is applied directly to it, although as mentioned it is possible for the liquid to be applied to the roller and subsequently transferred to the web. Such an applicator system is described in German patent document 3,623,402 of H. Sommer and H. Rückert.

Once the liquid has been applied to the roller or web it is usually subjected to a dosing operation when a doctor blade or the like strips off the coating liquid where it is too thick and/or smooths it to fill in any low areas. German patent document 4,014,463 describes a so-called air knife used to control coating thickness.

In a film-press system such as described in German patent document 4,033,521 of R. Knop and V. Fäthke the web is pinched between two rollers. One of the two rollers is associated with an applicator system for coating it and the web with the desired liquid.

With very great web widths of more than 8 m and web-travel speeds of more than 800 m/min it is difficult to apply the coating liquid to the web or roller fast enough to ensure uniform coating thickness. When applying the liquid directly to the web it is necessary to flow on the coating material in just the right amount at the lowest possible pressure, with minimal excess so that there is not much to scrape off downstream. Thus it is necessary to use, in order to maximize stability of the system, to use a large-diameter backing roller so that the web is not curved too much where the coating liquid is applied.

Published PCT application WO 94/23126 of R. Knop and H. Sommer describes an applicator system whose roller has a diameter of 5 mm to 200 mm and is braced against bending by a holder extending the full width of the apparatus. Since the applicator roller is relatively thin the dosing system can be situated immediately downstream of it to reduce the distance between where the coating is applied and scraped off. Bending forces caused by the weight of the applicator rod and the pressure in the application gap are reduced by the bracing so that it is possible to make the gap quite small.

OBJECTS OF THE INVENTION

It is therefore an object of the present invention to provide an improved web-coating apparatus.

Another object is the provision of such an improved web-coating apparatus which overcomes the above-given disadvantages, that is which has an improved applicator system that can spread rheologically different coating liquids uniformly and in any desired thickness on a web or roller.

SUMMARY OF THE INVENTION

The instant invention is used in a web-coating apparatus wherein a web moving continuously in a travel direction passes in a contact arc partially around a cylindrical surface of a backing roller centered on an axis. The invention is an applicator system having an applicator roller extending parallel to the backing roller, having a smooth cylindrical outer surface, and forming a gap with the backing roller. The web passes through the gap. A substantially stationary support extends generally parallel to the backing roll axis across a full width of the web and a pusher element limitedly movable generally radially toward and away from the backing-roller axis on the support bears radially of the backing-roller axis on the applicator roller along the full width of the web. An inflatable hose between the pusher element and the support along the full width of the web urges the element and applicator roller toward the backing roller. A coating liquid is supplied to the gap across the full width of the web.

With this applicator system it is possible to set an adjustable counterpressure to the hydrodynamic pressure in the application gap between the applicator roller and the web spanned over the backing roller or the backing roller in order to affect the hydrodynamic relationships. This can be used to achieve a uniform coating or to influence the extent the coating penetrates the web. Since the applicator roller is supported along its entire length its diameter can be set at any size necessary to optimize these hydrodynamic relationships and to reduce the likelihood of some problems like film splitting.

The pusher element according to the invention can be a cylindrical rod and the support forms a seat in which the rod is rotatable about an axis parallel to the backing-roll axis. The support is a bar of stiff elastomeric material formed with an axially elongated groove seat open toward the applicator roller and receiving the pusher element and hose. Alternately the pusher element is a bar extending the full width of the web and the bar and support are provided with interengageable abutments defining radial end positions of the bar on the support. The hose is between the bar and the support. This bar is of uniform section and has an inner surface that is convexly curved toward and engages the applicator roller. The hose can be a plurality of axially spaced and independently pressurizable sections.

Normally according to the invention the applicator roller has a diameter of between 40 mm and 600 mm, preferably 100 mm and 400 mm.

The supply for the coating liquid includes structure forming immediately upstream of the gap in the direction a compartment extending the full width of the web and a pump for filling the compartment with the coating liquid. The supply further has a lip having an edge spaced slightly upstream in the direction from the applicator roller and radially relative to the backing-roll axis slightly outward of the web.

The applicator system according to the invention also has a dosing system including a doctor blade juxtaposed with the web downstream from the applicator system for stripping off the coating liquid beyond a predetermined thickness of coating liquid on the web.

In another arrangement of this invention the dosing system also includes a second backing roller separate from the first-mentioned backing roller, having a respective axis generally parallel to the axis of the first backing roller, and bearing radially of its axis on the web at the doctor blade so that the web has a stretch that extends straight between the first and second backing rollers. The first backing roller has a diameter between 30 mm and 1000 mm and the second backing roller has a diameter between 500 mm and 1500 mm. The first and second backing rollers are spaced apart by at most 500 mm, preferably at most 200 mm. The second backing roller is above the first backing roller and the straight web stretch extends at an angle between 0° and 90° to the horizontal, preferably 30° and 60° to the horizontal. In addition the first and second backing rollers are relatively oriented such that an angle formed by a plane extending through the first-roller axis and the applicator roller and the straight stretch is between 0° and 135°, preferably 90°, to 135°, and the web is spanned over the second roller in relative to the second-roller axis an arc of 0° to 90°, preferably 3° to 60°.

It is also possible according to the invention for the web not to travel through the gap, but to engage the roller offset from the gap so that the liquid is applied to the roller and then transferred downstream to the web.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
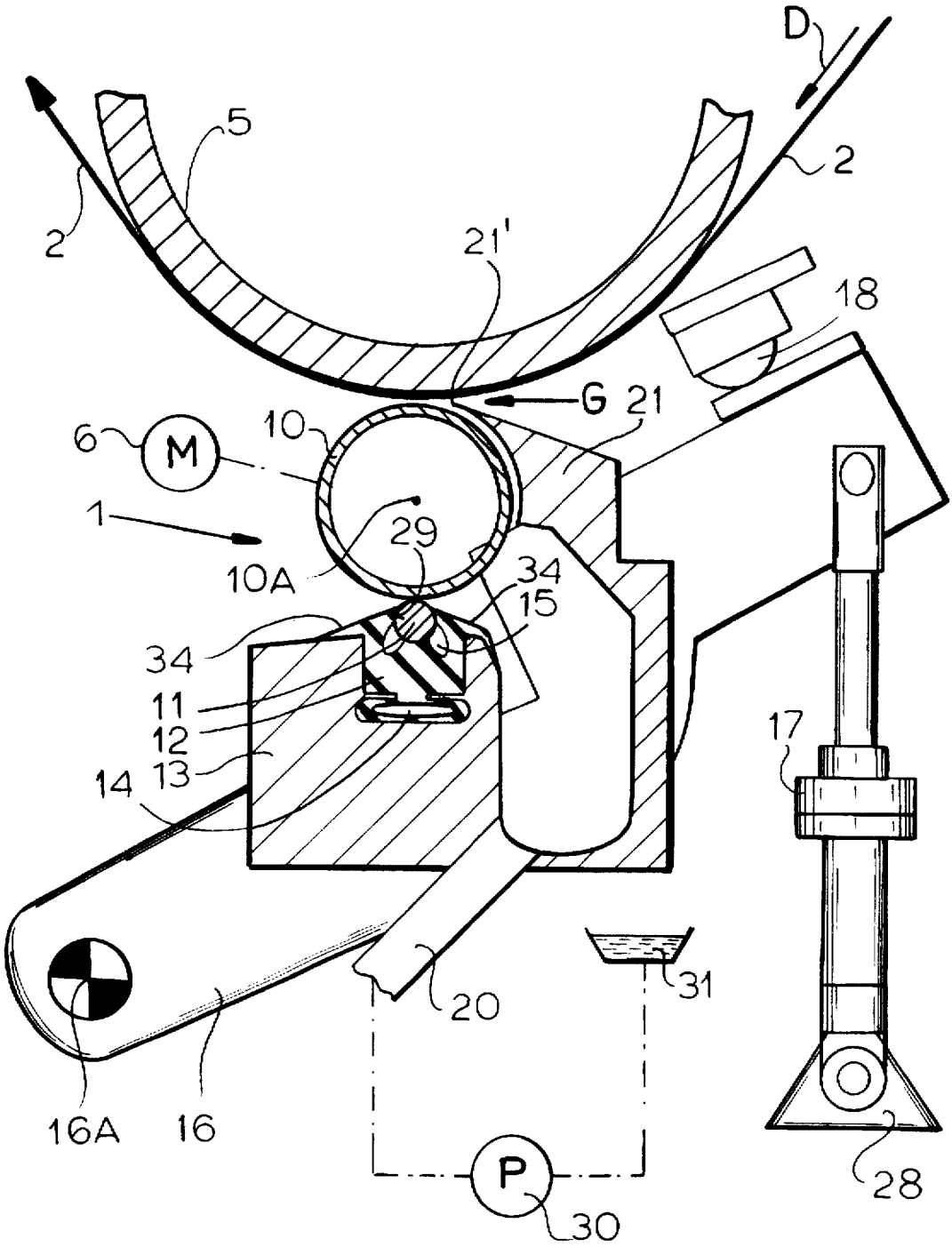
FIG. 1 is a partly diagrammatic vertical section through the web-coating apparatus according to the invention.
Figure 2:
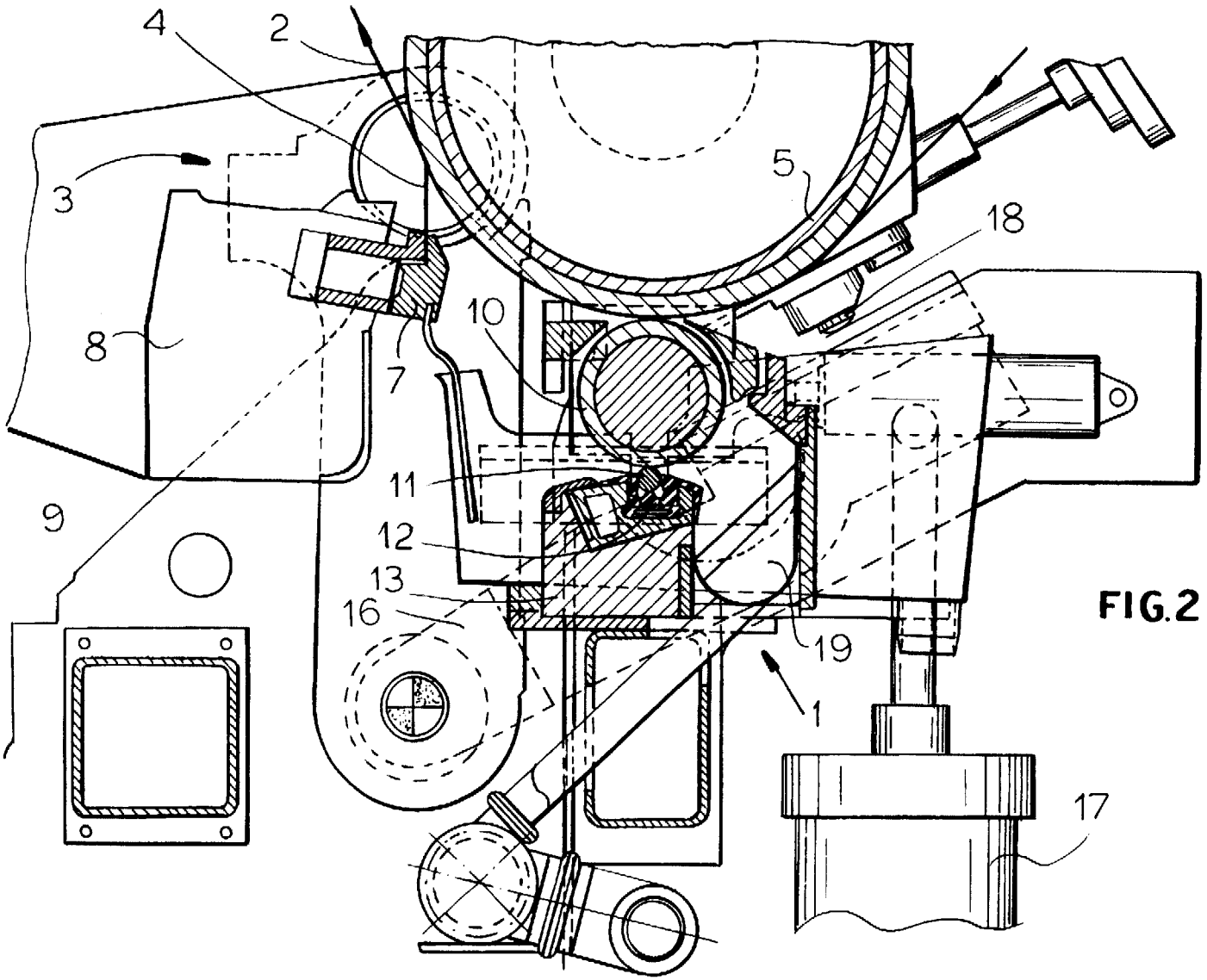
FIG. 2 is a view like FIG. 1 but showing somewhat more detail of the apparatus.

As seen in FIGS. 1 and 2, an applicator system 1 according to this invention is used to coat a paper or cardboard web 2 passing in a direction D around a backing roller 5 centered on an axis 5A and having a smooth cylindrical outer surface. An applicator roller 10 also having a smooth cylindrical outer surface and extending the full axial length of the roller 5 and width of the web 2 is centered on an axis 10A parallel to the axis 5A and rotated about this axis 10A by a drive motor illustrated diagrammatically at 6. This roller 10 is mounted loosely at its ends in arms 16 pivotal about an axis 16A parallel to the axes 5A and 10A. A hydraulic cylinder 17 has its piston rod pivoted on the outer ends of the arms 16 and its cylinder pivoted on a frame 28 of the machine. An abutment 18 fixed on the machine frame 28 engages the outer ends of the arms 16 to define an inner end position for the roller 10. The roller 10 has a diameter between 40 mm and 600 mm, preferably between 100 mm and 400 mm.

Downstream in the direction D from the applicator system 1 is a dosing system 3 (FIG. 2) having a doctor blade 4 that serves to strip excess coating liquid from the web 2. This blade 4 is carried on a holder 7 shiftable toward and away from the roller 5 on a support beam 8 carried between two end plates 9 of the machine. Thus it is possible to control the angle of the blade 4 relative to a tangent to the backing roller 5. It would also be possible to use a so-called pneumatic knife of the type described in German patent document 4,014,463.

The two arms 16 are spanned by a beam 13 into which is fitted an elastomeric but very stiff seat bar 12 forming a seat 29 carrying a pusher rod 11 parallel to the roller 10 and bearing radially of the axis 5A thereagainst. This rod 11 has a diameter of about 25 mm. The bar 12 is formed in its seat 29 with longitudinally extending inwardly open grooves 15 to minimize the friction between the solid pusher rod 11 and the bar 12 so this rod 11 can rotate freely as the drive 6 rotates the roller 10. Underneath the seat bar 12 in the beam 13 is a pneumatically inflatable hose 14 used for fine adjustment of the position of the pusher roller 10 radially of the axis 5A. The pressure in the hose 14 determines the hydrodynamic pressure in the gap G which in turn determines how deeply the coating liquid penetrates the web 2 so that in effect this pressure controls the extent of liquid penetration. In addition the bar 12 has lateral flanges or skirts 34 that engage down over the support beam 13 and prevent the coating liquid from getting under it. Normally the hose 14 is pressurized to produce a gap G having a radial dimension of between 0.01 mm and 2 mm, preferably about 0.8 mm between the roller 10 and the web 2.

The beam 13 forms immediately upstream of the roller 10 in the direction D a full-length liquid compartment 19 supplied with coating liquid through an inlet conduit 20 by a pump 30 from a supply 31 so that the body of liquid in the compartment 19 is in contact with the full length of the upstream side of the roller 10. A guide plate 21 carried on the beam 13 or even formed integrally therewith extends the full length of the roller 10 and has a part-cylindrical inner surface parallel to the outer surface of this roller 10 and forming an extension to the web 2 of the compartment 19. This plate 21 has an inner edge 21' set at a close spacing parallel to the outer surface of the roller 5 and, therefore, to the web 2.

The pump 30 supplies the liquid under considerable pressure to the compartment 19 so it flows out the narrow gap G between the edge 21' and the web 2. Some of this liquid coats the web 2 and is in fact forced into it by the hydrodynamic pressure of the liquid while the balance moves oppositely against the direction D to flow down over the upstream side of the guide plate 21 and back into the supply 31. It would of course be possible to use the system of this invention to coat a roller which transfers the coating to a web.

Figure 3:
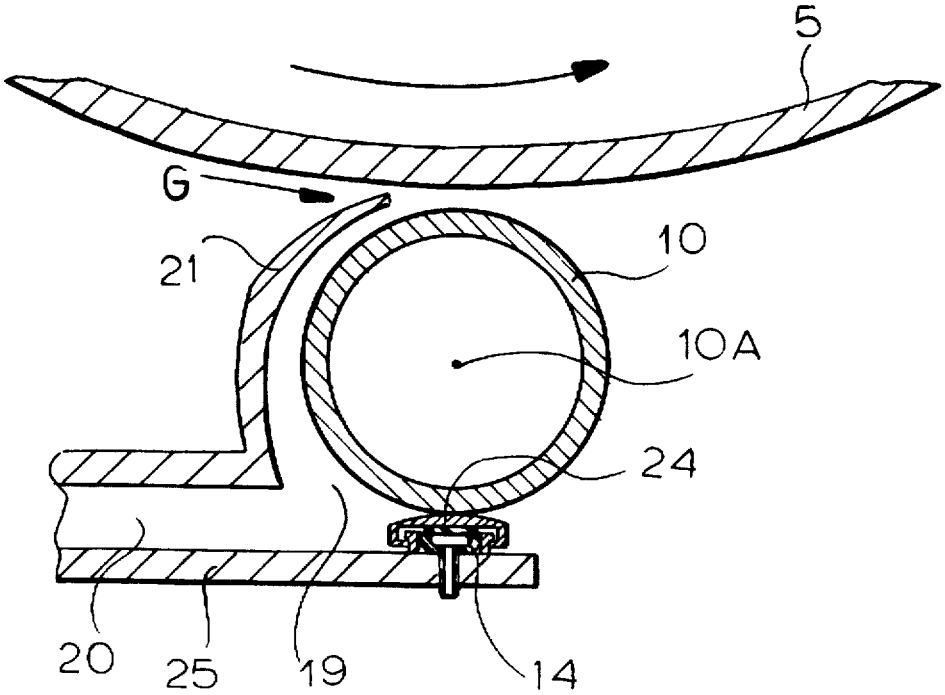
FIG. 3 is a large-scale view of a variant on the applicator system of FIG. 1.
Figure 4:
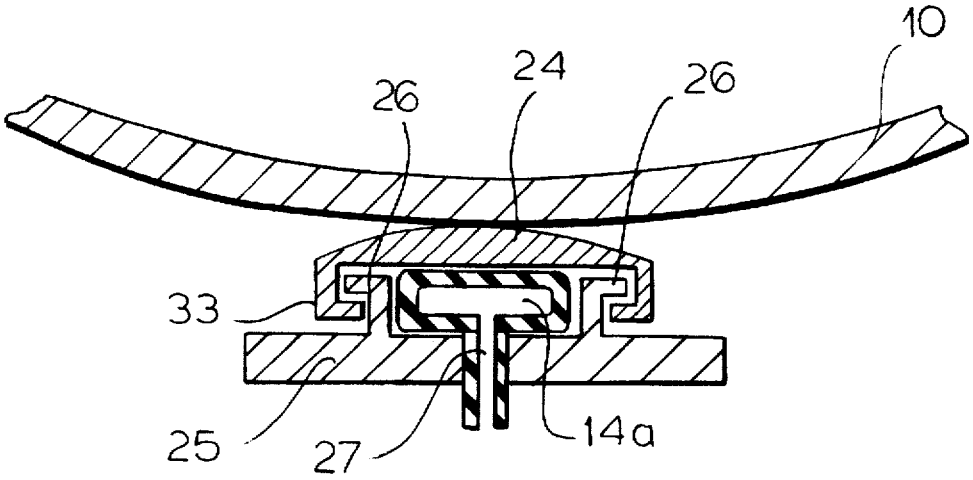
FIG. 4 is a large-scale view of a detail of FIG. 3.

FIGS. 3 and 4 show a variation on the arrangement of FIGS. 1 and 2 where the seat bar 12 is replaced by a full-length strip or rail 24 having a pair of L-shaped arms 22 engaging down around L-shaped rails on a part 25 of the beam 14 and a part-cylindrical outer surface directed convexly toward the roller 10. This system is similar to that of German patent document 3,338,323. The fit between the arms 25 and 33 is loose in a direction radial of the axis 10A and a plurality of short hoses 14a having respective feed conduits 27 are provided between the rail 24 and the support part 25. Thus these short hoses 14a can be differently inflated to compensate for local bending in the roller 10. The advantage of such a pusher bar 24 instead of the pusher rod 11 is that it does not need to be driven, so sealing its end is simplified. It is normally held stationarily during operation of the coating apparatus and in this case the coating liquid can be applied directly to the roller 5 for subsequent transfer to a web 2 contacting the roller 5 at a location downstream from the gap G.

Figure 5:
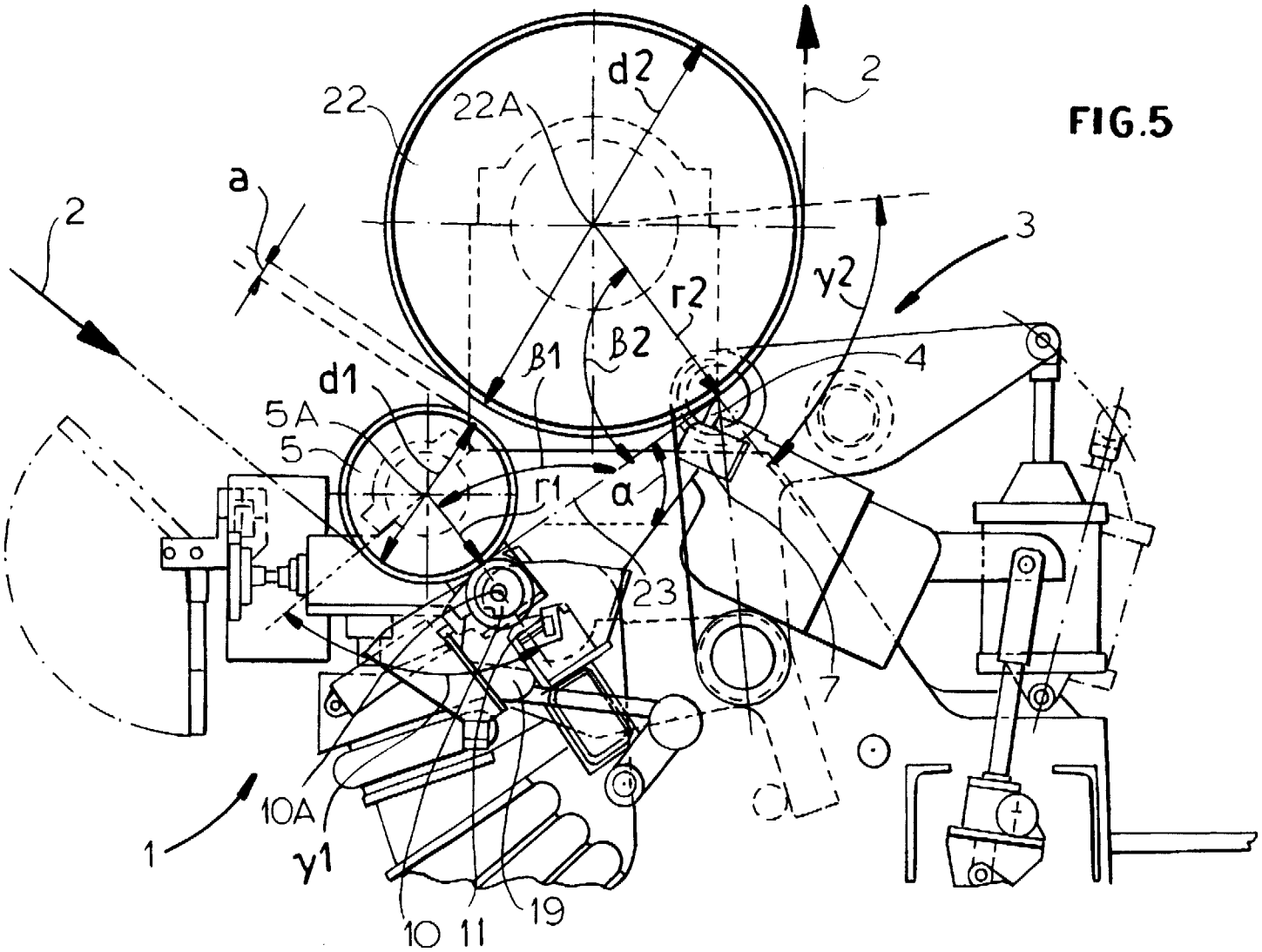
FIG. 5 is a view like FIG. 2 of another system according to the invention.

In FIG. 5 reference numerals identical to those of FIGS. 1 through 4 are used for functionally identical structure. Here, however, there is downstream in the direction D from the backing roller 5 a backing roller 22 centered on an axis 22A parallel to that of the roller 5. The dosing system 3 is juxtaposed with this second roller 22 so that the web 2 extends as a straight section 23 from the roller 5 to the roller 22. The purpose of this straight section 23 is to prevent the coating liquid from being thrown by centrifugal force off the web 2 as a result of the high travel speed in the direction D of the web 2. The roller 5 is of a diameter d1 between 300 mm and 1000 mm and the roller 22 of a diameter d2 between 500 mm and 1500 mm. A radial spacing a between these rollers 5 and 22 is as small as possible, normally less than 500 mm and preferably less than 200 mm. The stretch 23 extends at an angle α of 0° to 90°, preferably 30° to 60° to the horizontal, moving upward to the roller 22 so as to ensure good distribution and smoothing of the material applied at the coater 1 to the web 2 which may be moving in the direction D at upward of 1000 m/min. The sizes of the rollers 5 and 22 are selected such that, depending on the travel speed of the web 2, no oscillation occurs in the straight section 23.

In order that the web 2 moves in a straight line in the coating zone the applicator roller 10 is positioned such that an angle β1 between a radius r1 lying on a plane extending between the axis 5A and the axis 10A and the stretch 23 is between 85° and 95°, preferably 90°. An angle β2 between the stretch 23 and a radius r2 drawn from an axis 22A to the line where the web 2 first contacts the roller 22 is also equal to between 85° and 95°. Downstream of this line of first contact the web 2 rests in contact with the roller 22 over an arc having an arcuate dimension γ2 of between 0° and 90°, preferably 3° to 60°. Both rollers 5 and 22 are coated with a thin layer of natural or synthetic rubber to have a Shore hardness of about 80.

In the arrangement of FIG. 5 it would be possible to loop an endless support belt of a width somewhat greater than that of the web 2 around the two rollers 5 and 22. This belt would therefore support the web in the critical region 23, preventing it from vibrating and further ensuring that the coating thereon is not marred. In this case it would not be necessary to provide an elastomeric coating on the outer surfaces of the rollers 5 and 22.

We claim:

1. In a web-coating apparatus wherein a web moving continuously in a travel direction passes in a contact arc partially around a cylindrical surface of a backing roller centered on an axis, an applicator system comprising:

an applicator roller extending parallel to the backing roller, having a smooth cylindrical outer surface, and forming a gap with the backing roller, the web passing through the gap;

a substantially stationary support extending generally parallel to the backing-roller axis across a full width of the web;

a pusher element limitedly movable generally radially toward and away from the backing-roller axis on the support and having an inner surface convexly curved toward the backing-roller axis and bearing radially of the backing-roller axis in line contact on the applicator roller along the full width of the web;

means including an inflatable hose between the pusher element and the support along the full width of the web for urging the pusher element and applicator roller toward the backing roller; and means for supplying a coating liquid to the gap across the full width of the web.

2. The web-coating apparatus defined in claim 1 wherein the support has a bar of stiff elastomeric material formed with an axially elongated groove seat open toward the applicator roller and receiving the pusher element and hose.

3. The web-coating apparatus defined in claim 1 wherein the pusher element is a bar extending the full width of the web and the bar and support are provided with interengageable abutments defining radial end positions of the bar on the support, the hose being between the bar and the support.

4. The web-coating apparatus defined in claim 3 wherein the bar is of uniform section.

5. The web-coating apparatus defined in claim 1 wherein the hose has a plurality of axially spaced and independently pressurizable sections.

6. The web-coating apparatus defined in claim 1 wherein the applicator roller has a diameter of between 40 mm and 600 mm.

7. The web-coating apparatus defined in claim 1 wherein the applicator roller has a diameter of between 100 mm and 400 mm.

8. The web-coating apparatus defined in claim 1 wherein the supply means includes:

structure forming immediately upstream of the gap in the direction a compartment extending the full width of the web, and pump means for filling the compartment with the coating liquid.

9. The web-coating apparatus defined in claim 8 wherein the supply means further includes a lip having an edge spaced slightly upstream in the direction from the applicator roller and radially relative to the backing-roller axis slightly outward of the web.

10. The web-coating apparatus defined in claim 1, further comprising dosing means including a doctor blade juxtaposed with the web downstream from the applicator system for stripping off the coating liquid beyond a predetermined thickness of coating liquid on the web.

11. In a web-coating apparatus wherein a web moving continuously in a travel direction passes in a contact arc partially around a cylindrical surface of a backing roller centered on an axis, an applicator system comprising:

an applicator roller extending parallel to the backing roller, having a smooth cylindrical outer surface, and forming a gap with the backing roller, the web passing through the gap;

a substantially stationary support extending generally parallel to the backing-roller axis across a full width of the web;

a pusher element limitedly movable generally radially toward and away from the backing-roller axis on the support and bearing radially of the backing-roller axis on the applicator roller along the full width of the web;

means including an inflatable hose between the pusher element and the support along the full width of the web for urging the element and applicator roller toward the backing roller; and means for supplying a coating liquid to the gap across the full width of the web; and wherein the web-coating apparatus further comprising a dosing means including a doctor blade juxtaposed with the web downstream from the applicator system for stripping off the coating liquid beyond a predetermined thickness of coating liquid on the web, and a second backing roller separate from the first-mentioned backing roller, having a respective axis generally parallel to the axis of the first backing roller, and bearing radially of its axis on the web at the doctor blade, whereby the web has a stretch that extends straight between the first and second backing rollers.

12. The web-coating apparatus defined in claim 11 wherein the first backing roller has a diameter between 30 mm and 1000 mm, the second backing roller has a diameter between 500 mm and 1500 mm, and the first and second backing rollers are spaced apart by at most 500 mm.

13. The web-coating apparatus defined in claim 12 wherein the first and second backing rollers are spaced apart by at most 200 mm.

14. The web-coating apparatus defined in claim 12 wherein the second backing roller is above the first backing roller and the straight web stretch extends at an angle between 0° and 90° to the horizontal.

15. The web-coating apparatus defined in claim 14 wherein the straight web stretch extends at an angle between 30° and 60° to the horizontal.

16. The web-coating apparatus defined in claim 14 wherein the first and second backing rollers are relatively oriented such that an angle formed by a plane extending through the first-roller axis and the applicator roller and the straight stretch is between 0° and 135° and the web is spanned over the second roller in relative to the second-roller axis an arc of 0° to 90°.

17. The web-coating apparatus defined in claim 16 wherein the angle is at least 90°.

18. The web-coating apparatus defined in claim 16 wherein the arc is 3° to 60°.

19. In a web-coating apparatus wherein a web moving continuously in a travel direction passes in a contact arc partially around a cylindrical surface of a backing roller centered on an axis, an applicator system comprising:

an applicator roller extending parallel to the backing roller, having a smooth cylindrical outer surface, and forming a gap with the backing roller, the web passing through the gap;

a substantially stationary support extending generally parallel to the backing-roller axis across a full width of the web and forming a seat;

a cylindrical pusher rod rotatable in the seat about an axis parallel to the backing-roller axis, limitedly movable generally radially toward and away from the backing-roller axis on the support, and bearing radially of the backing-roller axis on the applicator roller along the full width of the web;

means including an inflatable hose between the pusher rod and the support along the full width of the web for urging the rod and applicator roller toward the backing roller; and means for supplying a coating liquid to the gap across the full width of the web.

* * * * *